US011815101B2

(12) United States Patent
Norwood et al.

(10) Patent No.: US 11,815,101 B2
(45) Date of Patent: Nov. 14, 2023

(54) CEILING FAN BLADE

(71) Applicant: HUNTER FAN COMPANY, Memphis, TN (US)

(72) Inventors: Bobby Neal Norwood, Oakland, TN (US); Charles William Botkin, Cordova, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 17/683,493

(22) Filed: Mar. 1, 2022

(65) Prior Publication Data

US 2023/0279869 A1 Sep. 7, 2023

(51) Int. Cl.
*F04D 29/38* (2006.01)
*F04D 19/00* (2006.01)

(52) U.S. Cl.
CPC ..... *F04D 29/384* (2013.01); *F04D 19/002* (2013.01)

(58) Field of Classification Search
CPC ..... F04D 29/384; F04D 19/002
See application file for complete search history.

(56) References Cited

U.S. PATENT DOCUMENTS

| | | | | |
|---|---|---|---|---|
| 2,283,956 | A * | 5/1942 | Smith | F03B 3/121 416/223 R |
| 6,685,436 | B2 * | 2/2004 | Huang | F04D 25/088 416/228 |
| 10,995,769 | B2 * | 5/2021 | Norwood | F04D 25/088 |
| 11,415,146 | B2 * | 8/2022 | Norwood | F01D 5/141 |
| 2003/0190234 | A1 * | 10/2003 | Huang | F04D 25/088 416/232 |
| 2007/0122286 | A1 * | 5/2007 | Leung | F04D 25/088 416/210 R |
| 2007/0154315 | A1 * | 7/2007 | Bucher | F04D 29/601 416/210 R |
| 2008/0069700 | A1 * | 3/2008 | Laisathit | F04D 29/384 416/242 |
| 2009/0263254 | A1 * | 10/2009 | Bucher | F04D 29/384 29/889.71 |
| 2010/0054947 | A1 * | 3/2010 | Chen | F04D 29/38 416/223 R |
| 2020/0224671 | A1 * | 7/2020 | Norwood | F04D 29/384 |
| 2021/0199131 | A1 * | 7/2021 | Botkin | F04D 29/38 |
| 2022/0034329 | A1 * | 2/2022 | Norwood | F04D 29/384 |

* cited by examiner

*Primary Examiner* — Aaron R Eastman
(74) *Attorney, Agent, or Firm* — McGarry Bair PC

(57) ABSTRACT

A ceiling fan or similar air-moving device can include a motor for rotating one or more blades to drive a volume of air about a space. The blade can include a body having an outer surface with a flat top surface and a flat bottom surface, and a side edge. A performance feature can be included in the body to improve efficiency. Due to manufacturing distortions, an offset can exist between the performance feature and other parts of the body. A transition portion can be formed at the offsets to remedy inefficiencies resultant of these distortions.

24 Claims, 5 Drawing Sheets

CEILING FAN BLADE

TECHNICAL FIELD

This application is directed to ceiling fans and devices for moving an airflow about a space such as a room, and more specifically to a blade for a ceiling fan.

BACKGROUND

Ceiling fans are machines traditionally suspended from a structure for moving a volume of air about an area. The ceiling fan includes a motor, with a rotor and stator, suspended from and electrically coupled to the structure. A set of blades mount to the rotor such that the blades are rotatably driven by the rotor, and can be provided at an angled orientation to move volume of air about the area. As the cost of energy becomes increasingly important, there is a need to improve the efficiency at which the ceiling fans operate.

BRIEF DESCRIPTION

In one aspect, the disclosure relates to a blade for a ceiling fan having a motor for rotating the blade, the blade comprising: a body extending between a root and a tip defining span-wise direction, and extending between a first side edge and a second side edge defining a chord-wise direction, an upper surface provided on the body; a performance feature provided between the first side edge and the upper surface; and a transition portion provided between the performance feature and at least one of the first side edge and the upper surface.

In another aspect, the disclosure relates to a blade for a ceiling fan, the blade comprising: a body including an upper surface and a lower surface; a side edge spacing the upper surface from the lower surface; a performance feature formed in one of the upper surface and the lower surface and extending along the side edge; and a transition portion provided along the performance feature transitioning between the performance feature and the side edge.

In another aspect, the disclosure relates to a method of forming a blade for a ceiling fan, the method comprising: forming a transition portion on the blade between a performance feature and a surface of the blade.

DETAILED DESCRIPTION

Figure 1:
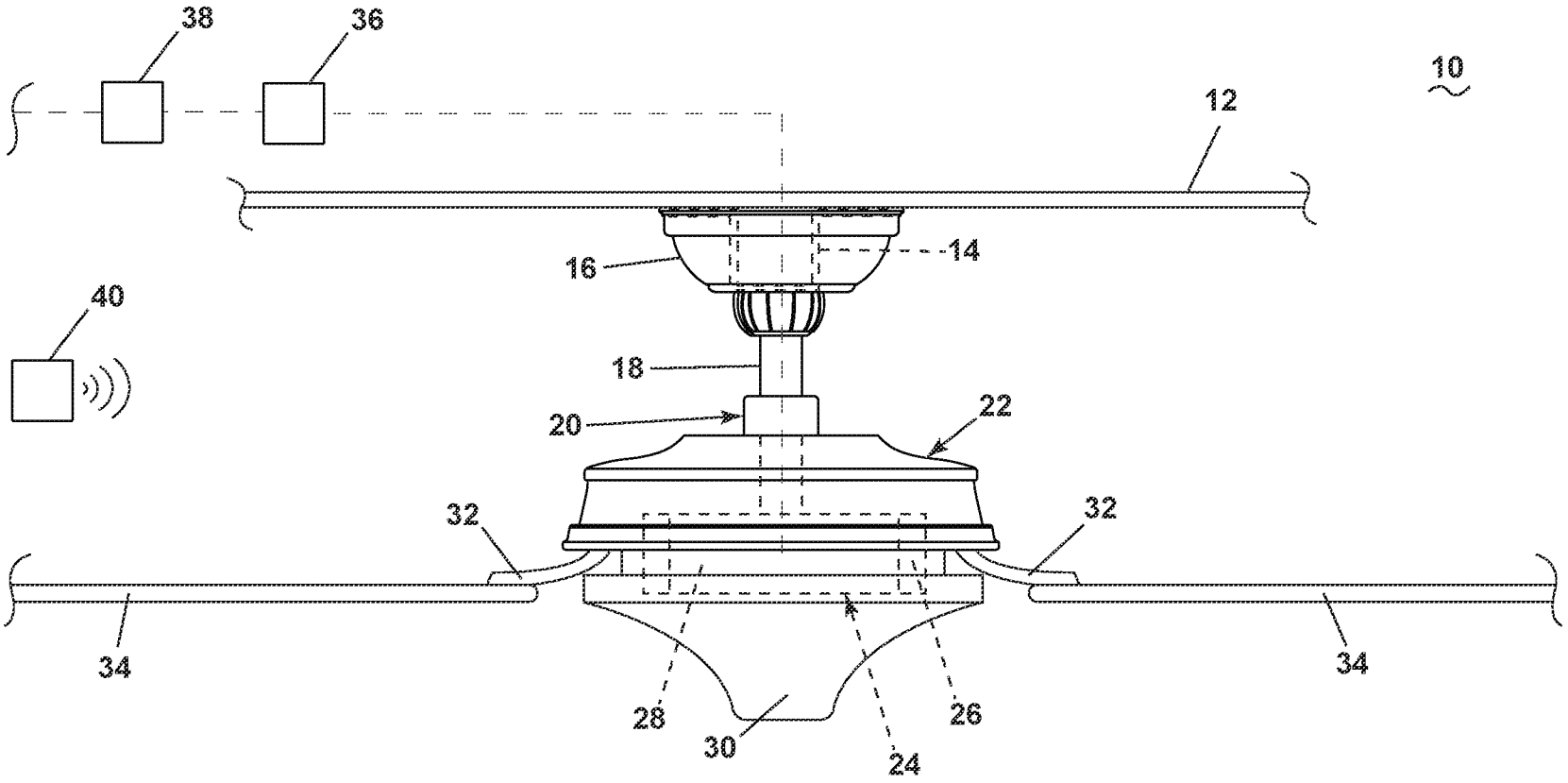
FIG. 1 is a schematic view of a structure with a ceiling fan suspended from a structure and including a set of blades.

The disclosure is related to a ceiling fan and ceiling fan blade, which can be used, for example, in residential and commercial applications. Such applications can be indoors, outdoors, or both. While this description is primarily directed toward a residential ceiling fan, it is also applicable to any environment utilizing fans or for cooling areas utilizing air movement, such as in an industrial, commercial, residential, or farming environment.

As used herein, the term "set" or a "set" of elements can be any number of elements, including only one. All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

Referring now to FIG. 1, a ceiling fan 10 is suspended from a structure 12. In non-limiting examples, the ceiling fan 10 can include one or more ceiling fan components including a hanger bracket 14, canopy 16, a downrod 18, a motor adapter 20, a motor housing 22 at least partially encasing a motor 24 having a rotor 26 and a stator 28, a light kit 30, and a set of blade irons 32. In additional non-limiting examples, the ceiling fan 10 can include one or more of a controller, a wireless receiver, a ball mount, a hanger ball, a light glass, a light cage, a spindle, a finial, a switch housing, blade forks, blade tips or blade caps, or other ceiling fan components. A set of blades 34 can extend radially from the ceiling fan 10, and can be rotatable to drive a volume of fluid such as air within a room defined by the structure 12. The blades 34 can be operably coupled to the motor 24 at the rotor 26, such as via the blade irons 32. The blades 34 can include a set of blades 34, having any number of blades, including only one blade.

The structure 12 can be a ceiling, for example, from which the ceiling fan 10 is suspended. It should be understood that the structure 12 is schematically shown and is by way of example only, and can include any suitable building, structure, home, business, or other environment wherein moving air with a ceiling fan is suitable or desirable. The structure 12 can also include an electrical supply 36 to electrically couple to the ceiling fan 10 to provide electrical power to the ceiling fan 10 and the motor 24 therein. It is also contemplated that the electrical supply be sourced from somewhere other than the structure 12, such as a battery or generator in non-limiting examples.

A controller 38 can be electrically coupled to the electrical supply 36 to control operation of the ceiling fan 10 via the electrical supply 36. Alternatively, the controller 38 can be wirelessly or communicatively coupled to the ceiling fan 10, configured to control operation of the ceiling fan 10 remotely, without a dedicated connection. Non-limiting examples of controls for the ceiling fan 10 can include fan speed, fan direction, or light operation. Furthermore, a separate wireless controller 40, alone or in addition to the wired controller 38, can be communicatively coupled to a controller or a wireless receiver in the ceiling fan 10 to control operation of the ceiling fan 10. It is further contemplated in one alternative example that the ceiling fan be operated by the wireless controller 40 alone, and is not operably coupled with the wired controller 38.

Figure 2:
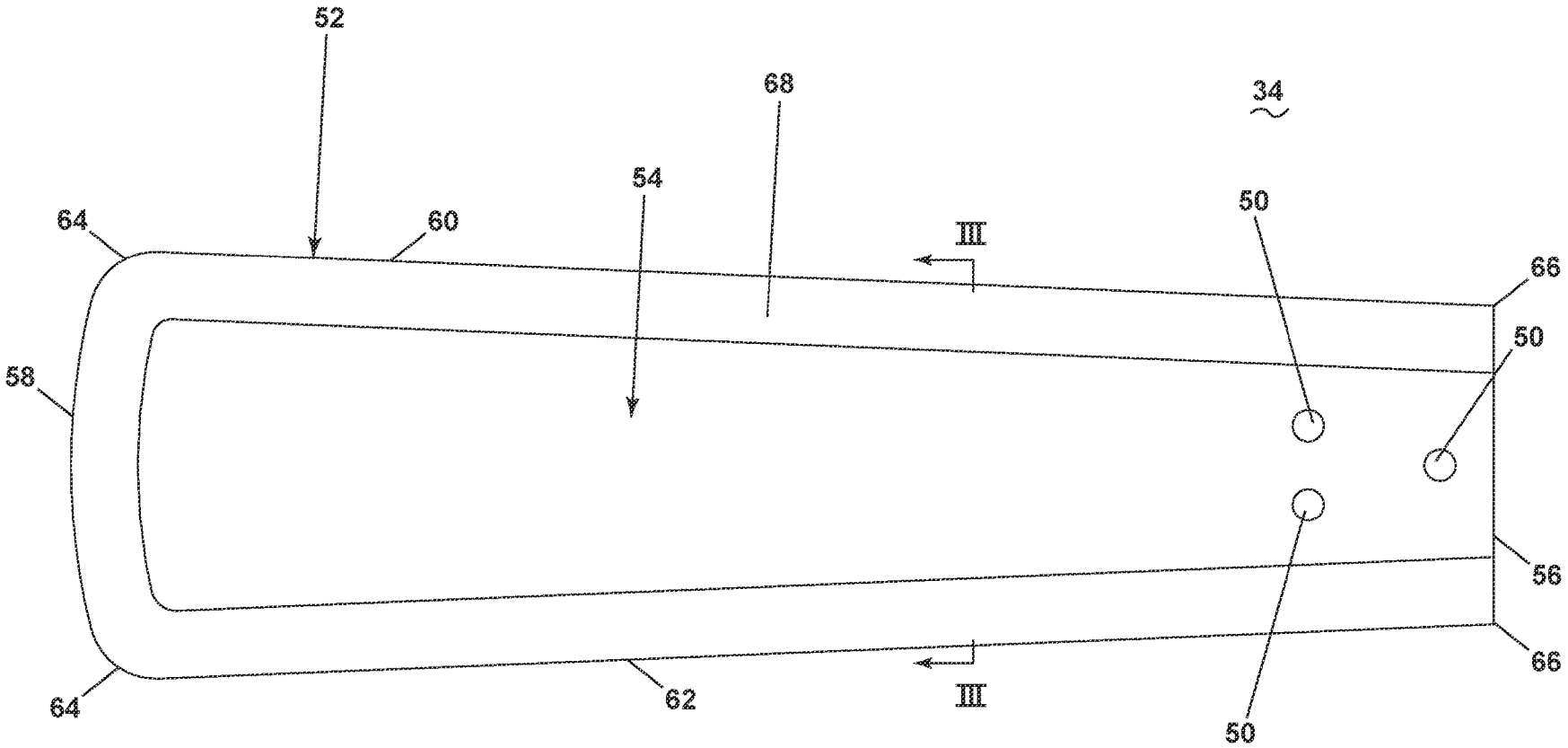
FIG. 2 is a top view of one blade from the set of blades or FIG. 1 having a curved surface transitioning to an edge of the blades.

In FIG. 2, the blade 34 includes three fastener apertures 50 for directly or indirectly fastening the blade 34 to the motor 24 for rotating the blade 34 about the fan 10 of FIG. 1, while any number of fastener apertures or blade-attachment method is contemplated. The blade 34 includes a body 52 including an outer surface 54. The blade 34 extends between a root 56 and a tip 58, defining a span-wise direction therebetween, and extends between a first side arranged as a first edge 60 and a second side arranged as a second edge 62, which can be a leading edge or a trailing edge depending on rotational direction of the blade 34, and defining a chord-wise direction extending between the first edge 60 and the second edge 62. Curved corners 64 transition between the tip 58 and the side edges 60, 62 and sharp corners 66 transition between the root 56 and the side edges 60, 62, while it should be appreciated that any corner type can be utilized. The blade 34 can widen in the chord-wise direction as it extends in the span-wise direction toward the tip 58, while any top-down shape for the blade is contemplated. Non-limiting examples of blade shapes can include squared, rectangular, trapezoidal, linear, curved, angled, rounded, converging, diverging, or combinations thereof.

Furthermore, the blade 34 can include a performance feature 68 provided along one or more of the first side edge 60, the second edge 62, and the tip 58, while the performance feature 68 extends along the root 56 only at the first and second edges 60, 62. It should be appreciated that the performance feature is not so limited, and can extend along any combination of the root 56, tip 58, first side edge 60, and second edge 62, or portions thereof.

Figure 3:
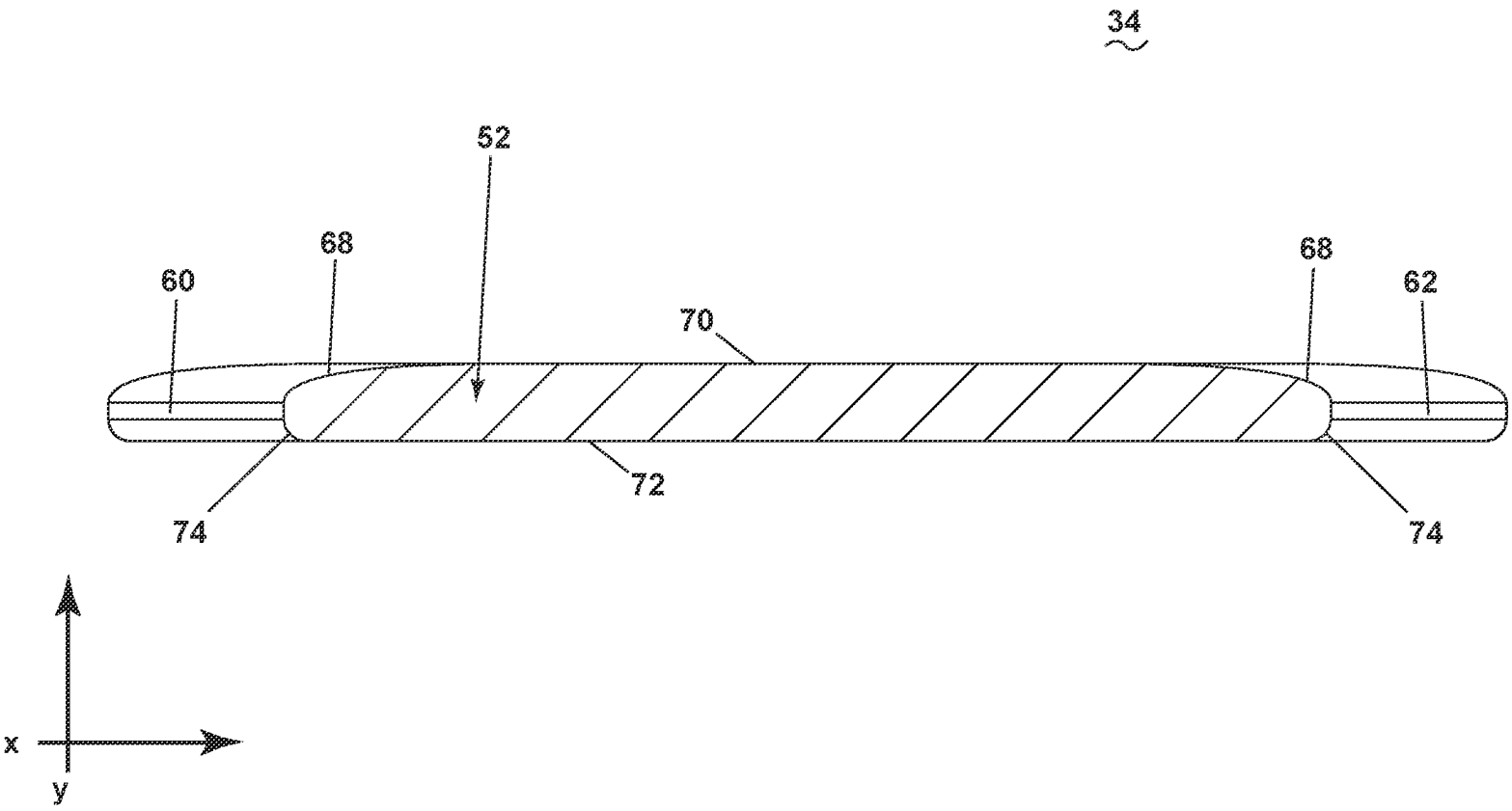
FIG. 3 is a sectional view of the blade of FIG. 2 illustrating the curved transition to the edge of the blades on a top surface and a bottom surface.

FIG. 3 shows a section view of the blade 34 taken across the section III-III of FIG. 2 along the chord-wise direction to show the profile of the blade 34. The body 52 further includes an upper surface and a lower surface arranged as a top surface 70 and a bottom surface 72, with a rounded edge 74 transitioning between the bottom surface 72 and the first and second edges 60, 62. The first side edge 60 and the second edge 62 can include a thickness spacing the top surface 70 from the bottom surface 72, such that the first and second edges 60, 62 define a planar edge, while a nominal thickness is contemplated such that the first and second edges 60, 62 define a line extending in the span-wise direction.

A performance feature as used herein can include a feature provided adjacent one of the first edges, or another performance feature. In non-limiting examples, the performance feature can include a chamfer, a curved surface defined by an elliptical, parabolic, hyperbolic, or logarithmic geometry, or a curved feature, such that the curvature defined by the performance feature is arranged where one or both of the upper surface and the side edge are aligned tangent to the curvature of the performance feature. Where the performance feature is adjacent to another performance feature, it is contemplated that the performance feature can be arranged as sets of performance features, where at least one performance feature is adjacent to the side edge, and another is adjacent to the upper surface.

The performance feature provides for improved aerodynamic performance for the fan blade, such that operation of the ceiling fan has increased total flow volume as compared with a blade without the performance feature, or that a reduction in energy requirements can be appreciated, while maintaining the aesthetic appearance of a traditional fan blade desirable by consumers.

For example, the performance feature 68 can include a curved surface, such as defining a portion of an airfoil profile, for example. In another example, the profile for the performance feature 68, as shown, can be defined by an elliptical curvature. That is, the curvature can include a portion of an ellipse, such as including a portion extending from one end of a major axis to another end of a minor axis. Furthermore, it is contemplated that the ellipse defined by the performance feature 68 can include a major axis that is parallel to one or both of the top surface 70 and the bottom surface 72.

More specifically, performance feature 68 can be represented by equation (1) written in standard form:

$$\frac{x^2}{a^2} + \frac{y^2}{b^2} = 1 \tag{1}$$

where x represents an x-axis and y represents a y-axis in Cartesian coordinates. An exemplary x-axis and y-axis are provided in FIG. 3. The y-axis can be defined in the direction extending from the top surface 70 to the bottom surface 72, and the x-axis can be defined in the chord-wise direction. Furthermore, a represents a length for the ellipse respective of the x-axis, and b represents a length for the ellipse respective of the y-axis. It should also be appreciated that where a=b, the ellipse can be a circle, defining no major or minor axis, as the diameters for a circle are equal. Additionally, all other ellipses can be non-circular, where a does not equal b, defining major and minor axes as the greatest and least diameters, respectively. Thus, it is contemplated that the performance feature 68 can define an elliptical shape, a non-circular elliptical shape, a parabolic shape, or a hyperbolic shape.

In another example, the performance feature 68 can be parabolic, an equation representing at least a portion of the curvature of the performance feature 68 can be represented in standard form as:

$$(x-h)^2=4p(y-k) \tag{2}$$

where the focus can be defined as (h, k+p) and the directrix is defined as y=k−p·x can represent the x-axis and y can represent the y-axis.

In another examples, where performance feature 68 is hyperbolic, an equation representing at least a portion of the curvature of the performance feature 68 can be represented in standard form as:

$$\frac{(x-h)^2}{a^2} - \frac{(y-k)^2}{b^2} = 1 \tag{3}$$

or $$\frac{(y-k)^2}{a^2} - \frac{(x-h)^2}{b^2} = 1 \tag{4}$$

where equation (5) is based upon a horizontal transverse axis and equation (6) is based on a vertical transverse axis, which ultimately depends on the local coordinate system defining performance feature 68. (h, k) can be used to define a center for the hyperbola, while x can represent the x-axis and y can represent the y-axis.

In yet another example, it is contemplated that the performance feature 68 can be formed as a planar chamfer, extending between the first edge 60 and the top surface 70. In yet another example, the performance feature 68 can be formed on both the top and the bottom of the blade, as well as, on both the first and second edges 60, 62. That is, a performance feature can be provided between a side edge and either or both of the top and bottom surfaces of the blade 34. Further still, it is contemplated that the use of multiple performance features can be utilized complementary to one another, or can differ from one another. For example, performance features can be common among the first and second edges 60, 62. In another example, the performance features can differ among the first and second edges 60, 62 depending on the intended direction of rotation of the blade, such that a leading edge can differ from a trailing edge, as well as relative to the top or bottom surfaces 70, 72.

Figure 4:
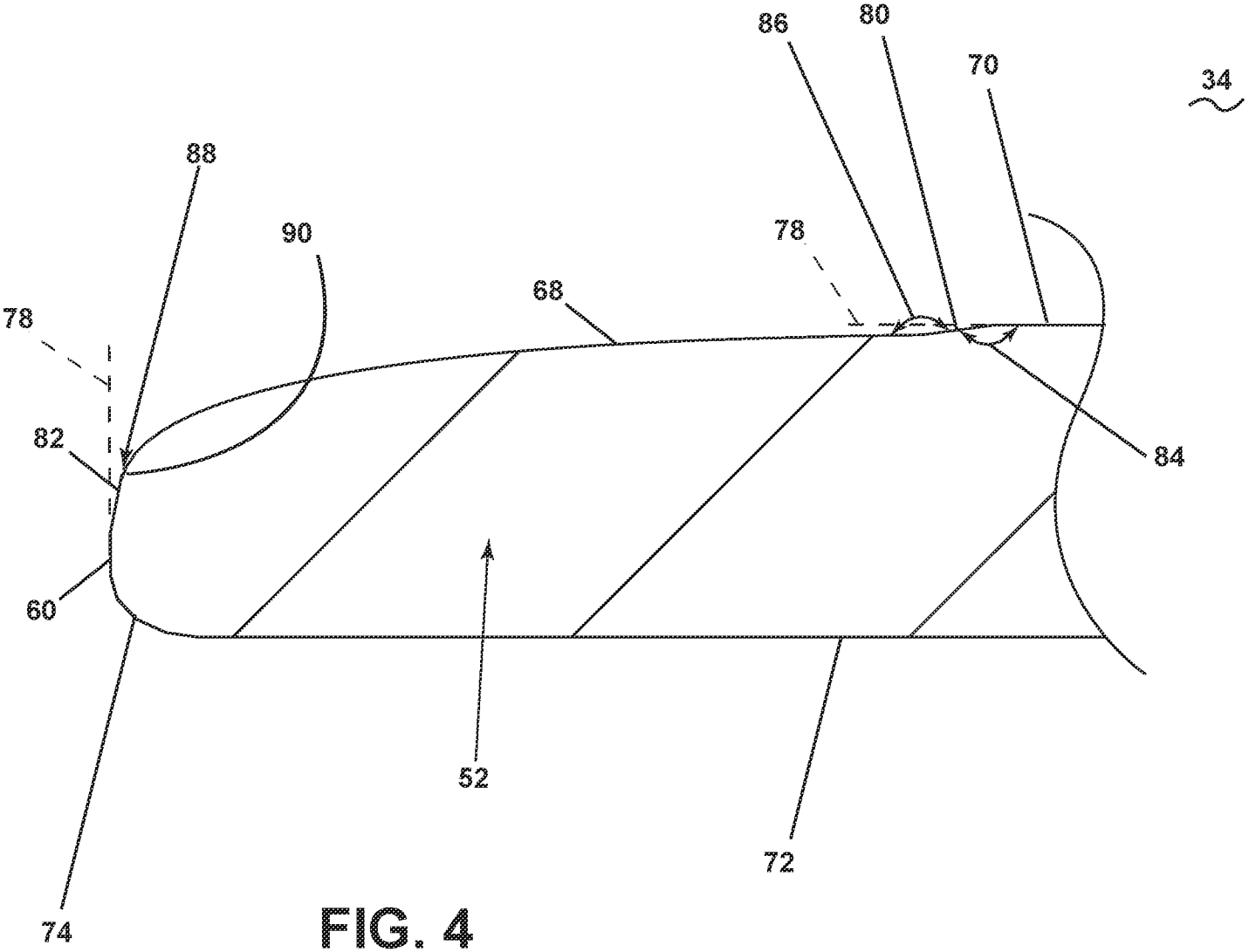
FIG. 4 is an enlarged sectional view of one edge of the blade of FIG. 3, illustrating an elliptical curved surfaces of the blades.

Turning to FIG. 4, a transition portion can be provided between the performance feature 68 and at least one of the top surface 70 and the first edge 60. As a result of manufacturing distortions, an offset 78 can be created between the performance feature 68 and one or both of the top surface 70 and the first edge 60. More specifically, the performance feature 68 can be machined into the body 52 of the blade 34, such that the performance feature 68 is not aligned with the remaining portions of the body 52, creating the offset 78. While the offset is only shown at the top surface 70 and the first edge 60, it should be appreciated that the offset 78 can be provided at the first or second edge 60, 62, the top surface 70, the bottom surface 72, or any other portion of the body 52. Where the performance features 68 includes a curvature, such a curvature can be non-tangent to the rest of the body 52 where the performance feature 68 meets the rest of the body 52. Such an offset can be formed as a step, for example, while the particular geometry of the offset 78 can be particular to the manufacture method or geometry of the performance feature 68.

As shown, a first transition portion 80 is provided between the top surface 70 and the performance feature 68, and a second transition portion 82 provided between the first edge 60 and the performance feature 68. The first transition portion 80 can provide for a smooth transition from the performance feature 68 to the top surface 70. The first transition portion 80 can be planar, with the plane defined offset from top surface 70 by an offset angle 84, and similarly, can be offset from a plane or line defined by the performance feature 68, by a second offset angle 86. More specifically, the offset angles 84, 86 can be defined as the angle between a plane defined by the transition portion 80 and a plane defined by the top surface 70, and a plane defined by the transition portion 80 and the performance feature 68. In one example, the angle can be defined along a plane defined as the section through the blade 34, as shown in section in FIG. 4, Such a section can be defined perpendicular to a planar top surface 70 or a planar bottom surface 72, for example. In another example, the offset angle 84, 86 can be between 179-degrees and 91-degrees, or between 179-degrees and 135-degrees, while other ranges are contemplated. As the performance feature 68 can be curved, the plane defined by the performance feature 68 can be a line tangent to the curvature of the performance feature 68 where it meets the first transition portion 80.

Similarly, the second transition portion 82 can provide for a smooth transition from the performance feature 68 to the first edge 60 to transition from the offset 78 to the first edge 60. The second transition portion 82 can be planar, with the plane defined by the second transition portion 82 being offset from first edge 60 of the performance feature 68. As the performance feature 68 can be curved, the plane defined by the performance feature 68 can be tangential to the curvature of the performance feature 68 where it meets the second transition portion 82. While only shown at the first edge 60 and the top surface 70, it should be understood that additional transition portions can be provided between any performance feature and any of the first or second edges 60, 62 or the top or bottom surfaces 70, 72.

In operation, the transition portions 80, 82 provide for a smooth transition between the performance feature 68 and other portions of the blade body 52. The smoothed transitions reduce turbulence and other inefficiencies that would otherwise occur without the transition portions. Further, during manufacture, distortions while cutting or extruding the blades can provide for an offset between a performance feature and the other portions of the body of the blade. These offsets generate inefficiencies during operation. Utilizing the transition portions as described herein mitigate the inefficiencies generated by the offsets, increasing ceiling fan efficiency.

It should be further understood that the transition portions 80, 82 can leave additional distortions 88 between the transition portions 80, 82 and one or more of the first edge 60, performance feature 68, or the top surface 70, or any other portion of the blade 34 adjacent to a transition portion 80, 82. These distortions 88 can be shaped to further reduce additional inefficiencies. Shaping these distortions 88 can provide a shaped junction 90, such as by sanding or grinding, providing smooth transitions between the transition portions 80, 82 and adjacent portions of the blade 34.

Figure 5:
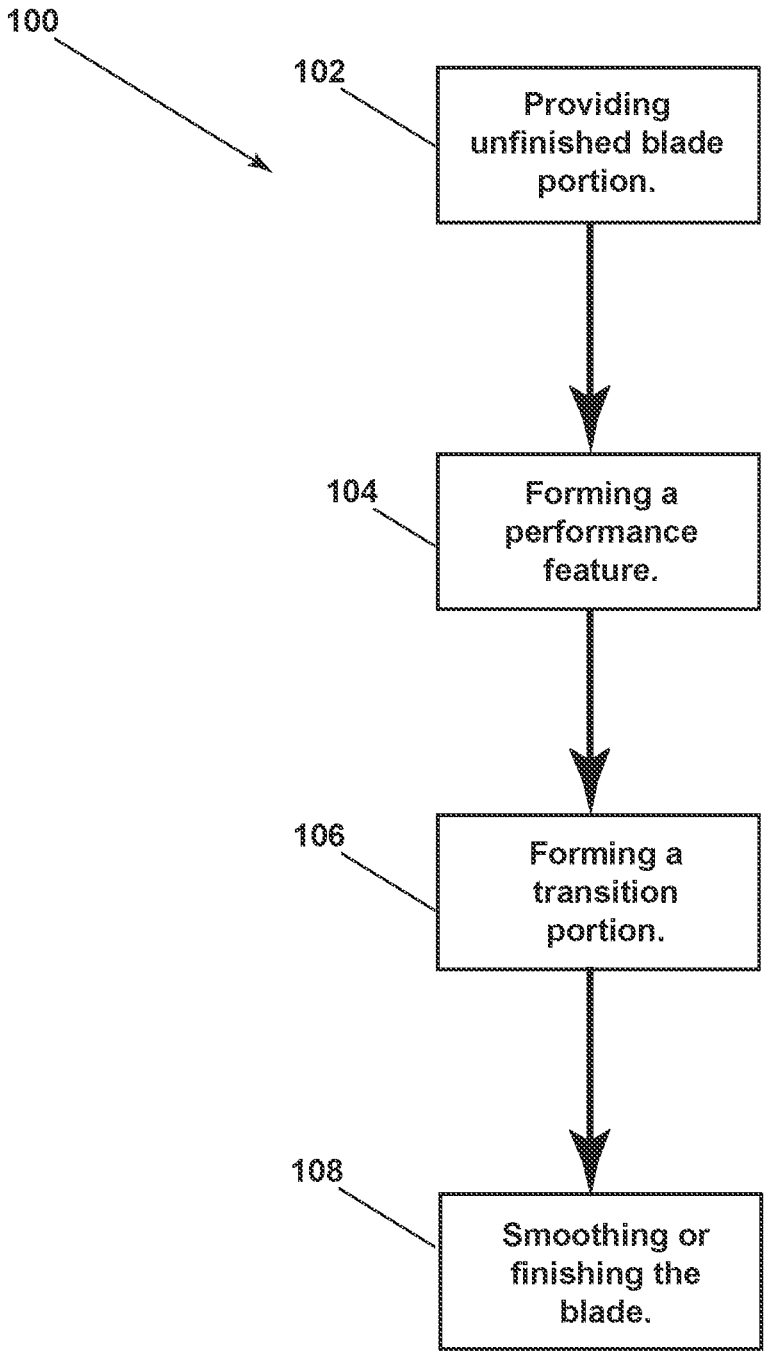
FIG. 5 is a flow chart illustrating a method of forming a blade.

Referring to FIG. 5, a method 100 of forming a ceiling fan blade can include, at 102, providing an unfinished blade portion. The unfinished blade portion can be a blade that has not yet been worked upon to form a performance feature into the blade. At 104, a performance feature can be formed on or into the blade, such as the performance feature 68 of FIGS. 3-4. For example, a cutting machine can cut away a portion of the unfinished blade portion to form the performance feature. In another example, the blade can be extruded from the unfinished blade portion to include the performance feature by virtue of the extrusion, while any suitable method to form the performance feature is contemplated.

Due to manufacturing distortions, an offset is created between the performance feature and the other portions of the blade. Where the performance features include a curvature, such a curvature can be non-tangent to the rest of the blade body where the performance feature meets the rest of the blade body. Such an offset can be formed as a step, for example, while any geometry at the offset is contemplated.

At 106, at least one transition portion can be formed on or into the blade at the offset, such as the transition portions 80, 82 described herein. Forming the transition portion can include any suitable method for removing portions of the blade, such as grinding or cutting, in non-limiting examples.

At 108, the method 100 can further include smoothing the edges at the transition portion. Forming the transition portion can leave additional distortions, such as hard or sharp edges at the junction between the transition portion and another surface, such as the top or bottom surfaces, or the first or second edges. Smoothing these edges, such as with sanding, can remove these additional distortions, further smoothing the blade.

Forming the transition portion, as well as smoothing thereafter, can increase efficiency by removing distortions created during forming of the performance feature, which would otherwise create unintended turbulence or wake that decreases fan blade efficiency. Utilizing the transition portion with the performance feature realizes the benefits of the performance feature without suffering the deficiencies resultant of manufacturing distortions.

The blades and sections thereof as described herein provide for both increased total flow volume for a ceiling fan, resulting in increased efficiency, while maintaining the aesthetic appearance that consumers desire. More specifically, the transition portions, as well as in addition to the performance features, provide for increased downward force on air which increases the total volume of airflow, while the flat upper and lower surfaces of the blade match traditional fan blade styles, providing a pleasing or appealing user aesthetic.

To the extent not already described, the different features and structures of the various features can be used in combination as desired. That one feature is not illustrated in all of the aspects of the disclosure is not meant to be construed that it cannot be, but is done for brevity of description. Thus, the various features of the different aspects described herein can be mixed and matched as desired to form new features or aspects thereof, whether or not the new aspects or features are expressly described. All combinations or permutations of features described herein are covered by this disclosure.

This written description uses examples to detail the aspects described herein, including the best mode, and to enable any person skilled in the art to practice the aspects described herein, including making and using any devices or systems and performing any incorporated methods. The patentable scope of the aspects described herein are defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blade for a ceiling fan having a motor for rotating the blade, the blade comprising:

a body extending between a root and a tip defining a span-wise direction, and extending between a first side edge and a second side edge defining a chord-wise direction, a planar upper surface defined by the body;

a first performance feature provided between the first side edge and the planar upper surface, and the first performance feature defines a first curved surface, with an elliptical profile, extending between the first side edge and the upper surface;

a planar transition portion provided between the first performance feature and the planar upper surface; and a second performance feature between the planar upper surface and the second side edge, with the second performance feature defining a second surface that is different than the first curved surface.

2. The blade of claim 1 further comprising a shaped junction between the transition portion and the first performance feature.

3. The blade of claim 1 wherein the transition portion is arranged at an angle relative to the upper surface.

4. The blade of claim 3 wherein the angle is between 179 degrees and 135 degrees.

5. The blade of claim 4 wherein the transition portion is arranged at a second angle relative to the first performance feature.

6. The blade of claim 5 wherein the second angle is between 179 degrees and 135 degrees.

7. The blade of claim 6, further comprising a second transition between the first performance feature and the first side edge, with the second transition being planar.

8. The blade of claim 7, wherein the first side edge is planar.

9. The blade of claim 1 wherein the transition portion is formed as a first transition portion between the first performance feature and the first side edge and a second transition portion between the first performance feature and the upper surface.

10. The blade of claim 9 wherein the first transition portion and the second transition portion are formed along both the first side edge and the second side edge.

11. The blade of claim 1 wherein the performance feature extends fully between the root and the tip.

12. The blade of claim 11 wherein the transition portion extends along and is complementary to the first performance feature.

13. The blade of claim 1, wherein the second surface of the second performance feature is curved.

14. The blade of claim 13, wherein the second curved surface of the second performance feature defines at least one of a parabolic profile or a hyperbolic profile.

15. The blade of claim 1, wherein the second surface of the second performance feature is planar.

16. The blade of claim 15, wherein the second side edge is planar.

17. A method of forming a blade for a ceiling fan, the method comprising:

forming a transition portion on the blade between one of a first or second performance feature and a planar upper surface of the blade, with the one of the first or second performance features defining a first curved surface with an elliptical profile, the other of the first or second performance features defining a second surface, different than the first curved surface, and a planar transition portion provided between one of the first and second performance features and the planar upper surface.

18. The method of claim 17 further comprising forming the one of the first and second performance features prior to forming the transition portion.

19. The method of claim 17 further comprising shaping the blade at a junction between the transition portion and at least one of the first and second performance features and the surface of the blade.

20. The method of claim 17 wherein the surface of the blade is one of a top surface or a side edge.

21. The method of claim 17 wherein the blade includes an offset between the one of the first and second performance features and the surface, and the transition portion transitions between the performance feature and the surface at the offset.

22. A blade for a ceiling fan having a motor for rotating the blade, the blade comprising:

a body extending between a root and a tip defining a span-wise direction, and extending between a first side edge and a second side edge defining a chord-wise direction, a planar upper surface defined by the body;

a first performance feature provided between the first side edge and the planar upper surface, and the first performance feature defining first curved surface having a parabolic profile extending between the first side edge and the planar upper surface;

a planar transition portion provided between the first performance feature and at least one of the first side edge and the planar upper surface; and a second performance feature between the planar upper surface and the second side edge, with the second performance feature defining a second surface that is different than the first curved surface.

23. A blade for a ceiling fan having a motor for rotating the blade, the blade comprising:

a body extending between a root and a tip defining a span-wise direction, and extending between a first side edge and a second side edge defining a chord-wise direction, a planar upper surface defined by the body;

a first performance feature provided between the first side edge and the planar upper surface, and the first performance feature defining a first curved surface having a hyperbolic profile extending between the first side edge and the planar upper surface;

a planar transition portion provided between the first performance feature and at least one of the first side edge and the planar upper surface; and a second performance feature between the planar upper surface and the second side edge, with the second performance feature defining a second surface that is different than the first curved surface.

24. A blade for a ceiling fan having a motor for rotating the blade, the blade comprising:

a body extending between a root and a tip defining a span-wise direction, and extending between a first side edge and a second side edge defining a chord-wise direction, a planar upper surface defined by the body;

a first performance feature provided between the first side edge and the planar upper surface, and the first performance feature defines a first curved surface extending between the first side edge and the upper surface;

a planar transition portion provided between the first performance feature and the planar upper surface; and a second performance feature between the planar upper surface and the second side edge, with the second performance feature defining a second surface that is different than the first curved surface.

* * * * *